US006470784B1

(12) United States Patent
Bonavita et al.

(10) Patent No.: US 6,470,784 B1
(45) Date of Patent: Oct. 29, 2002

(54) DEFENSE SYSTEM FOR AN ANTI-INTRUSION AREA

(75) Inventors: Patrick Bonavita; Claude Boutet, both of Bourges (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/559,097

(22) Filed: Apr. 27, 2000

(30) Foreign Application Priority Data

May 20, 1999 (FR) ..... 99 06451

(51) Int. Cl.[7] ..... F41H 5/007
(52) U.S. Cl. ..... 89/36.17
(58) Field of Search ..... 89/36.17

(56) References Cited

U.S. PATENT DOCUMENTS 1,434,132 A 10/1922 McDonald
3,214,857 A 11/1965 Tyrone et al.
5,739,458 A * 4/1998 Girard ..... 89/36.02
5,792,976 A 8/1998 Genovese ..... 102/293
6,029,558 A * 2/2000 Stevens et al. ..... 89/36.17
6,128,999 A * 10/2000 Sepp et al. ..... 89/36.17

FOREIGN PATENT DOCUMENTS

DE 197 15 464 A1 10/1998
WO WO 97/23852 7/1997

* cited by examiner

*Primary Examiner*—Stephen M. Johnson
(74) *Attorney, Agent, or Firm*—Parkhurst & Wendel, L.L.P.

(57) ABSTRACT

A protection device against intrusion of a zone including at least one bag firmly affixed to at least one support, the bag having a flexible envelope inflatable by at least one gas or fluid generator triggered by control means. Upon inflation of the flexible envelope, the envelope spreads apart above the support to subtend a substantially cylindrical volume having an axis substantially parallel to the support and of dimensions adequate to constitute a barrier to hamper advance toward the zone protected by the device.

18 Claims, 6 Drawing Sheets

DEFENSE SYSTEM FOR AN ANTI-INTRUSION AREA

BACKGROUND OF THE INVENTION

The field of the present invention relates to devices of reduced lethality for protecting a zone against intrusion.

DESCRIPTION OF THE RELATED ART

To enable graduated response in site protection, "non-lethal" defensive apparatus are increasingly being developed.

Such apparatus slow or deter an individual and are designed to cause few if any injuries.

They either urge the threat to flight, or temporarily neutralize it to allow conventional forces of law and order to intervene.

Regarding zone protection, apparatus dispersing tear gas or irritating substances are in known use.

Such apparatus are effective only over a limited range, unless excessive quantities of tear gas are employed, thereby endangering the victims' eyes.

Moreover such apparatus are difficult to use in the open, for instance near a camp where the active ingredients quickly dilute.

SUMMARY OF THE INVENTION

The objective of the present invention is to create a reduced-lethality device protecting a zone which is free of the above drawbacks.

Accordingly, the device allows hampering, in non-oxic and non-lethal manner, intruders entering a given zone.

The device also allows a graduated response to the intrusion.

Moreover, the installation of the device of the invention can be matched to a particular zone's geometry.

The device may operate in fully automated manner, or by remote control.

Accordingly, the device relates to protecting a zone against intrusion and characterized in that it comprises at least one bag firmly affixed to at least one support, said bag comprising a flexible envelope which may be inflated by at least one gas or fluid generator triggered by control means, said flexible envelope inflating above the support so as to occupy a substantially cylindrical volume having an axis parallel to the support, and its dimensions being adequate to constitute a barrier hampering advance toward the zone protected by said device.

Advantageously, the support includes, or may be fitted with, at least one intrusion detector connected to the control means.

The support may include or may be fitted with at least one tube launching at least one projectile.

The support may bear or be fitted with at least one launcher tube pointing in a substantially vertical direction and housing as needed a warning projectile.

Illustratively the warning projectile may be fitted with a pyrotechnic charge generating noise and/or light.

The warning projectile may include a tear-gas charge.

The launcher tube may be driven by control means in response to intrusion detection.

Bag inflation then may be triggered by the control means in the event of continued detection of intrusion following firing the launcher tube.

In another embodiment of the invention, the support may be fitted with a substantially rectangular surface and have adequate flexibility for rolling about a winding axis parallel to its width.

Advantageously, the support shall comprise at least one prohibition marker.

At least at one of its ends, the support may be fitted with electrical connector means to link it to at least another similar support.

At least at one of its ends, the support may bear mechanical links with which to firmly affix it to another similar support.

Advantageously, the control means may be common to at least two supports.

The gas generator may include at least one pyrotechnic generator.

The gas generator may include at least one compressed-gas bottle.

The control means may be linked to receivers receiving remote commands.

The bag may be coated with an adhesive.

BRIEF DESCRIPTION OF THE DRAWINGS

The invention is elucidated by the following description of a number of different embodiment modes and in relation to the attached drawings.

DESCRIPTION OF THE INVENTION

Figure 1:
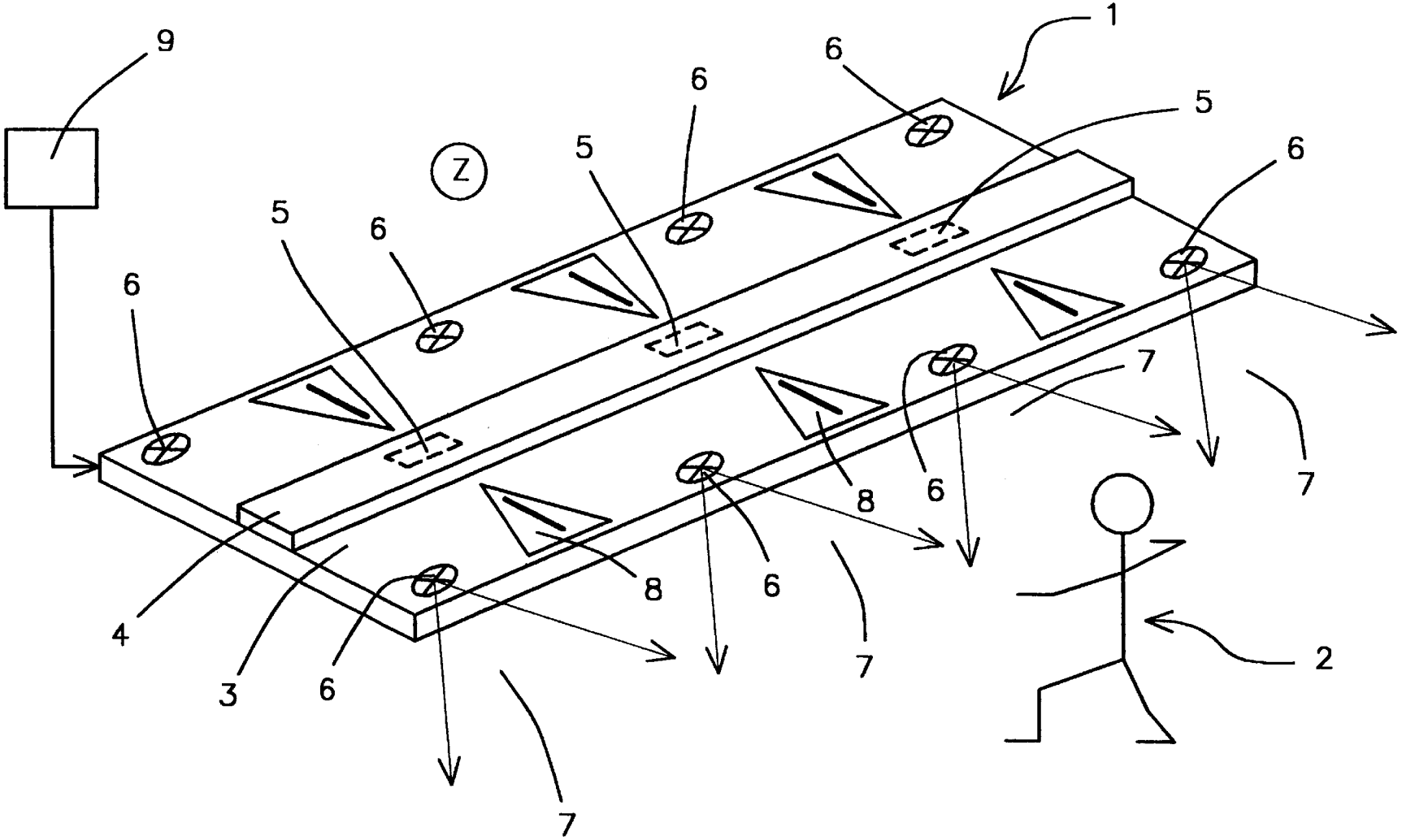
FIG. 1 is a schematic perspective of a protection device of a first embodiment of the invention, the device being shown in the standby mode.

FIG. 1 shows a protection device 1 of the invention to prevent or hamper (2) access to a zone Z by an intruder 2.

This device comprises a support 3 which may have some rigidity to be more easily kept on the ground.

Illustratively, this support may be a metal plate or a composite plate. It may be anchored in the ground using for instance (omitted) stakes.

Illustratively, the support shall be rectangular, and its length may be within 5 and 10 m and its width between 1.5 and 2.5 m.

Figure 3:
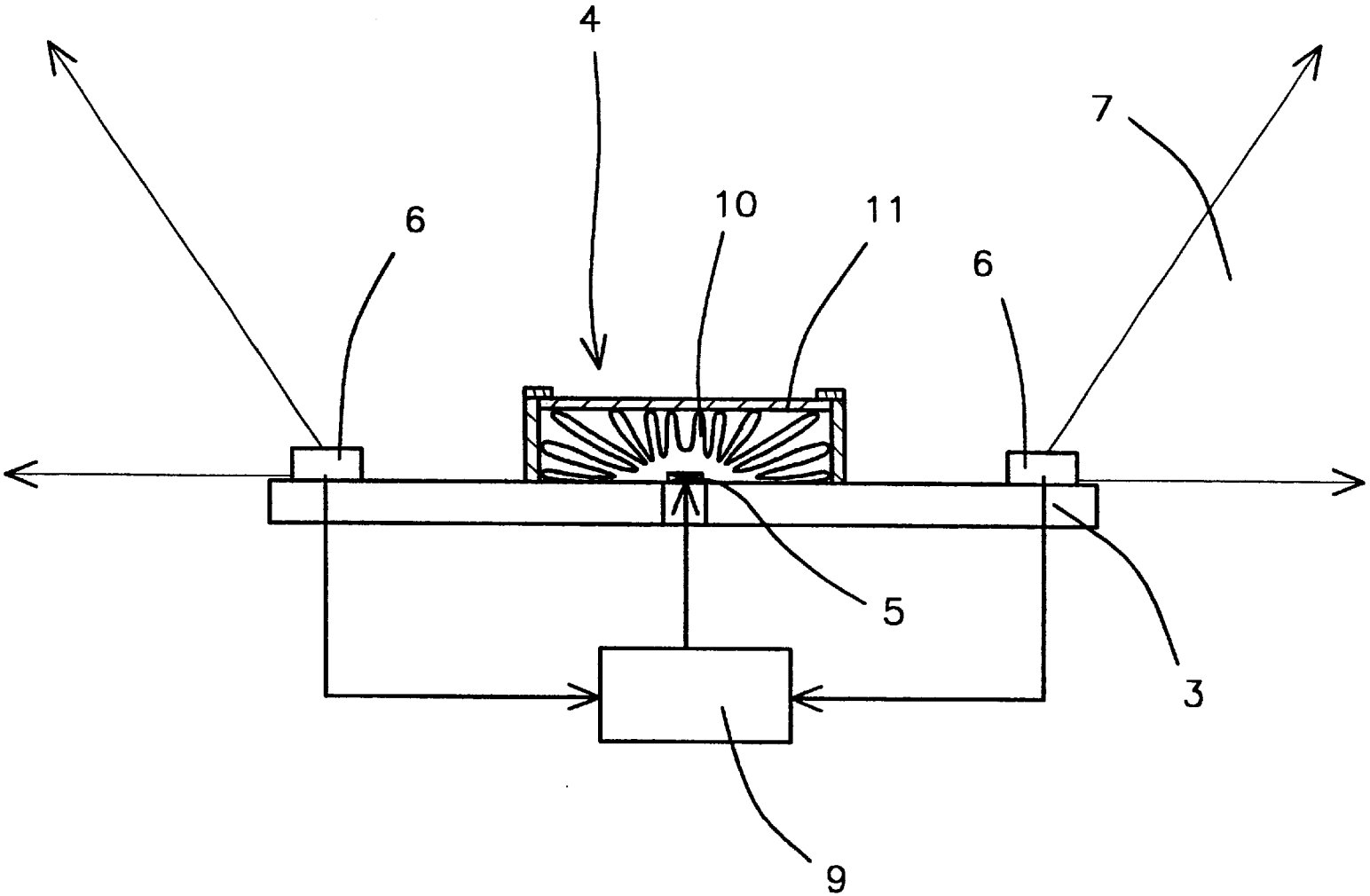
FIG. 3 is a schematic cross-section of the device of FIG. 1.

FIG. 3 shows a cross-section of said device. The support 3 bears a bag 4 which is shown schematically in its collapsed position. The bag comprises an inflatable envelope 10 received in a protective box 11. The bag envelope 10 can be inflated by at least one gas generator 5 (three generators being shown in FIG. 1). Such inflation also ruptures the box 11. Preferably the gas generator 5 is a pyrotechnic generator similar to those used in automobile airbags.

The pyrotechnic gas generators includes a gas generating composition initiated by firing a pyrotechnic component itself triggered by an electric signal.

Illustratively, the envelope 10 may consist of a tough but flexible material such as a polyamide or kevlar or it may be made of an elastic material such as an elastomer. The envelope optionally can be reinforced, for instance, by stitching or by rubber strips bonded to the envelope and configured as a grid. Such a configuration makes the envelope more pressure and tear proof against external factors.

The envelope is firmly affixed to the support, for instance, by bonding or by means of clamps.

The engineering relating to the gas and inflatable bags are well known in automobile airbags. Illustratively, the European patent document 529,371 describes a material for making such a bag and the patents U.S. Pat No. 5,062,367; FR 2,691,706 and EP 509,655 describe gas generators for car air bags.

Also, the support 3 also is fitted with several intrusion detectors 6, for instance infrared or mm range detectors, each with a detection field 7 pointing outside the zone Z.

Preferably, the detectors 6 are configured in regularly distributed manner along at least one of the largest dimensions of the support 3.

Advantageously, and as shown in FIG. 1, the detectors 6 are arrayed along the two parallel lengths of the support 3. Such a configuration renders the device symmetrical and allows for detecting intruders on either side of the support 3. In this manner, the device operability is enhanced by making it possible to install it in two different positions along the zone Z.

Furthermore, the support 3 may be fitted at its visible upper surface with markings 8 acting as prohibiting signs against entering the protected zone. Illustratively, these might be strips of loud colors, written prohibitions, alarm signals.

The device also comprises electronic control means 9 linked to the detectors 6 and to the gas generators 5.

The control means include algorithms to compare the signals from the detector(s) 6 with those stored in the device's memory.

Figure 2:
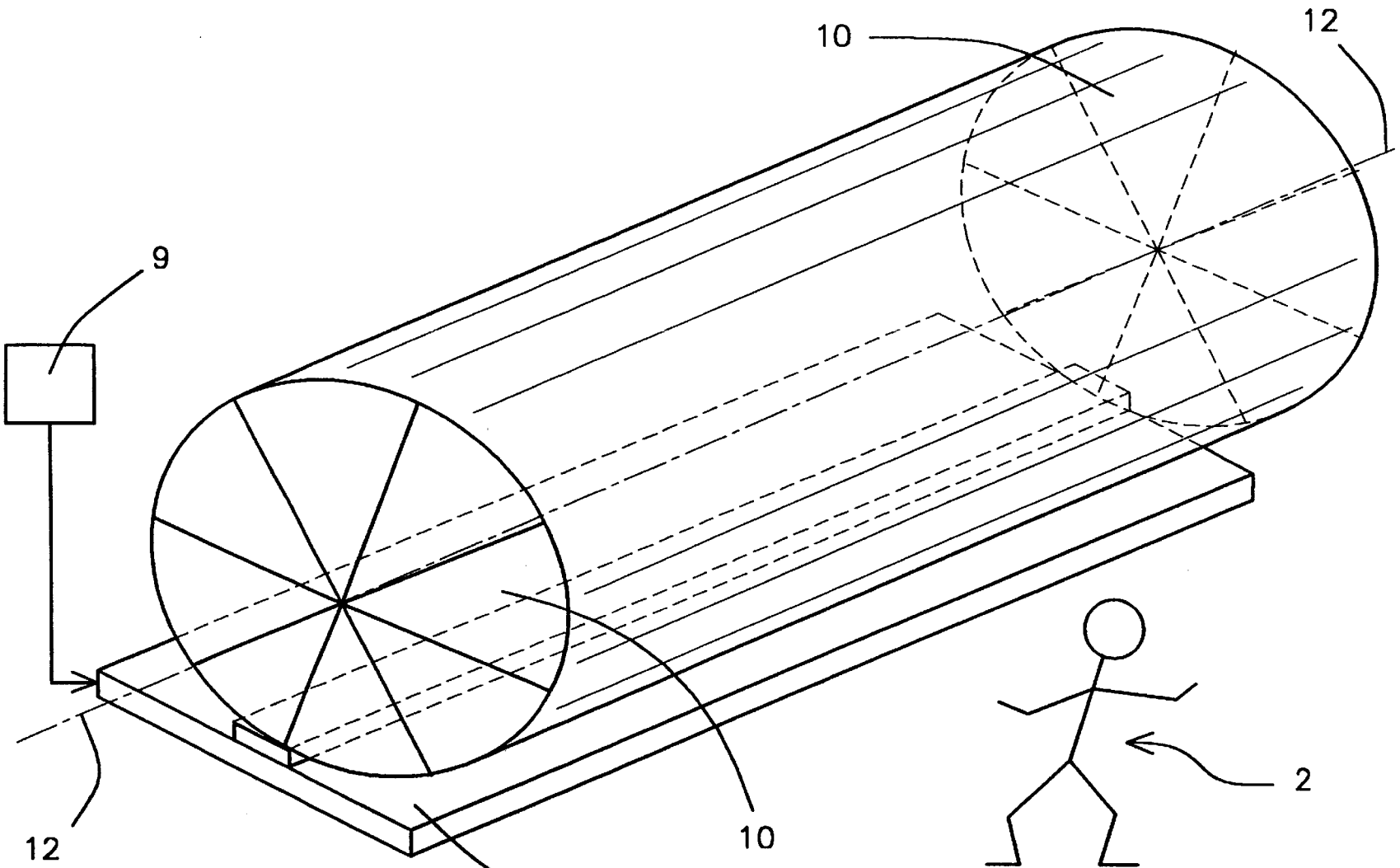
FIG. 2 is a view similar to the preceding one and shows the device in its operational position.

The device operates as follows:

Once the device has been installed along one of the borders of the protected zone Z, the detectors 6 situated on a single side of the support are activated. These detectors monitor the space near the zone Z. When an intruder 2 nears the device at a distance (about 2 to 5 m), which is adjustable by means of the controls as a function of the effect delivered on the intruder, the control means 9 cause the envelope 10 to inflate (FIG. 2).

The envelope spreads out above the support 3 so as to subtend a cylindrical volume having an axis 12 substantially parallel to the support 3. The envelope 10 provides a linear barrier with dimensions such that the intruder's progress through the device is impossible or at least hampered.

Illustratively, for a support 10×2 m in size, a cylindrical bag 2–3 m in diameter and about 10 m long can be inflated.

Advantageously, the control means 9 can be linked to an alarm emitting an acoustic and/or light signal and also notify a remote surveillance station.

Preferably, the detectors 6 are detachably affixed to the support 3 to ease maintenance and storage.

In a variation of the embodiment of the invention, the pyrotechnic gas generators can be replaced by one or more compressed-gas bottles linked to the inside volume of the envelope 10 by a valve which shall be opened by the control means 9.

Furthermore, the gas generator may be replaced by a polymerizing foam generator, for instance a polyurethane foam. This foam solidifies within the bag's envelope and rigidities it, thus increasing the barrier effect and preventing piercing of the bag. Such a foam is described in WO8800882, an application to rapid float implementation.

Also, the bag 10 can be externally coated with an adhesive such as epoxy or acrylate glue. Such a design further slows any intruder's progress.

Figure 4:
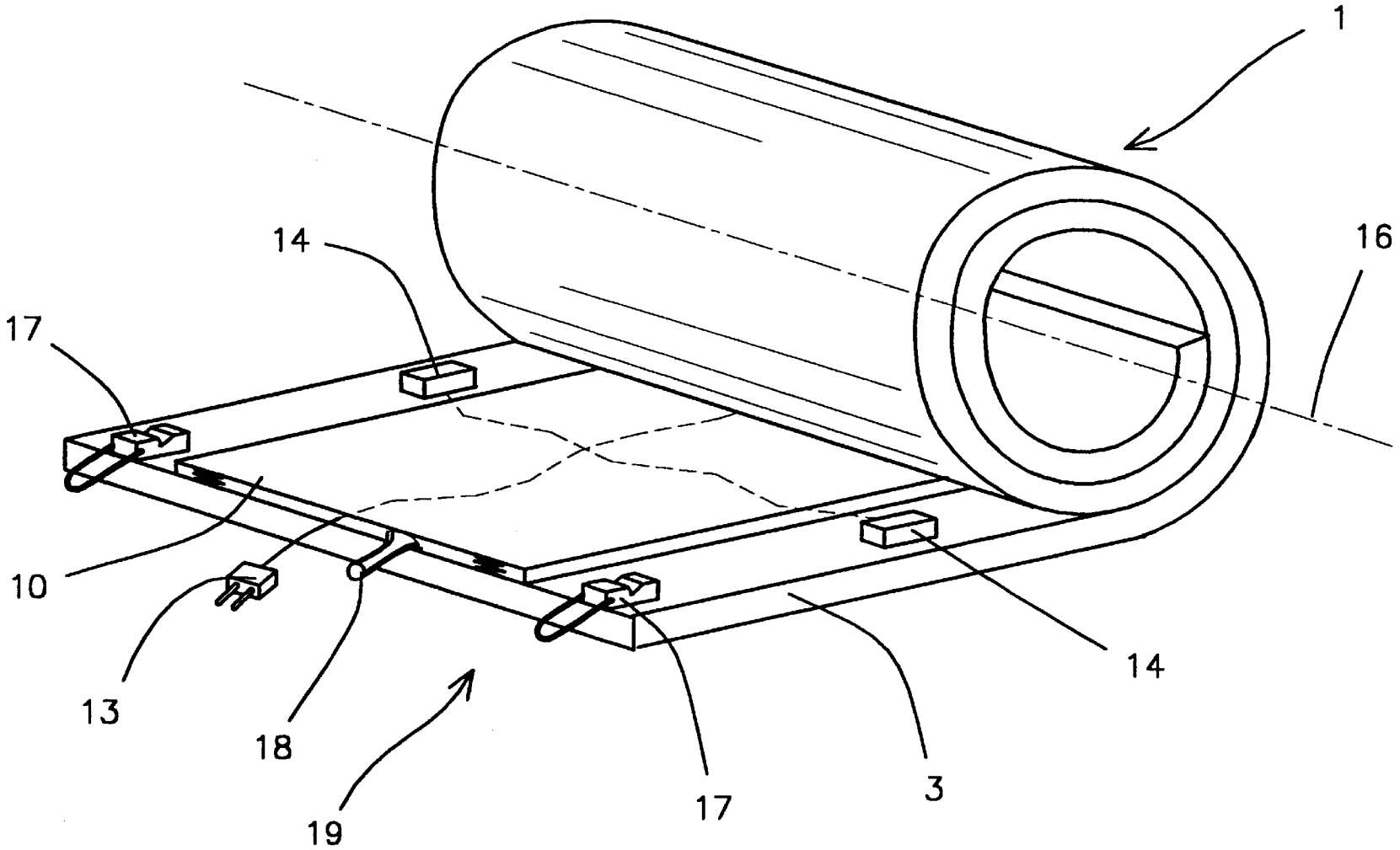
FIG. 4 shows an installation mode of a device of a second implementation of the invention.

FIG. 4 shows a device of a second embodiment of the present invention. In this second embodiment, the support 3 is implemented in the form of a flexible mat, for instance made of rubber or foam and 15 to 25 mm thick. This mat bears the collapsed envelope 10 which is firmly joined to the mat, for instance by bonding or cast-molding.

The end 19 of the mat 3 is fitted with mechanical links 17, such as snap-in fasteners, whereby one support 3 can be firmly joined to another similar support. To allow such affixation, the other mat end is fitted with complementary link elements.

Near one end 19, the mat 3 is fitted with electric links 13 connected by conductors 15 to connectors 14 which are regularly distributed along the support 3 and connect the detectors 6. The other mat end is fitted with complementary connectors.

The electric connector means 13 also electrically connect the support to a similar support.

The flexible support 3 is substantially rectangular. It may be rolled up about a winding axis 16 which runs parallel to its width. The connectors 14 are thin, and therefore do not interfere with rolling up the support 3.

To facilitate rolling up the mat, the bag envelope 10, in this instance, can be inflated by an external gas generator (a pyrotechnic generator or a compressed air bottle) to which it is connected through a conduit 18.

Such an embodiment facilitates storage and actuation of the device: Several supports 3 are unrolled on the terrain to constitute a barrier of a given length. Next, the supports are affixed to each other by the links 17 and electrically interconnected by the electric links 13.

Thereupon, the various supports 3 are fitted with detectors 6 and gas generators, and the assembly so constituted is connected to the common control means 9.

Figure 6:
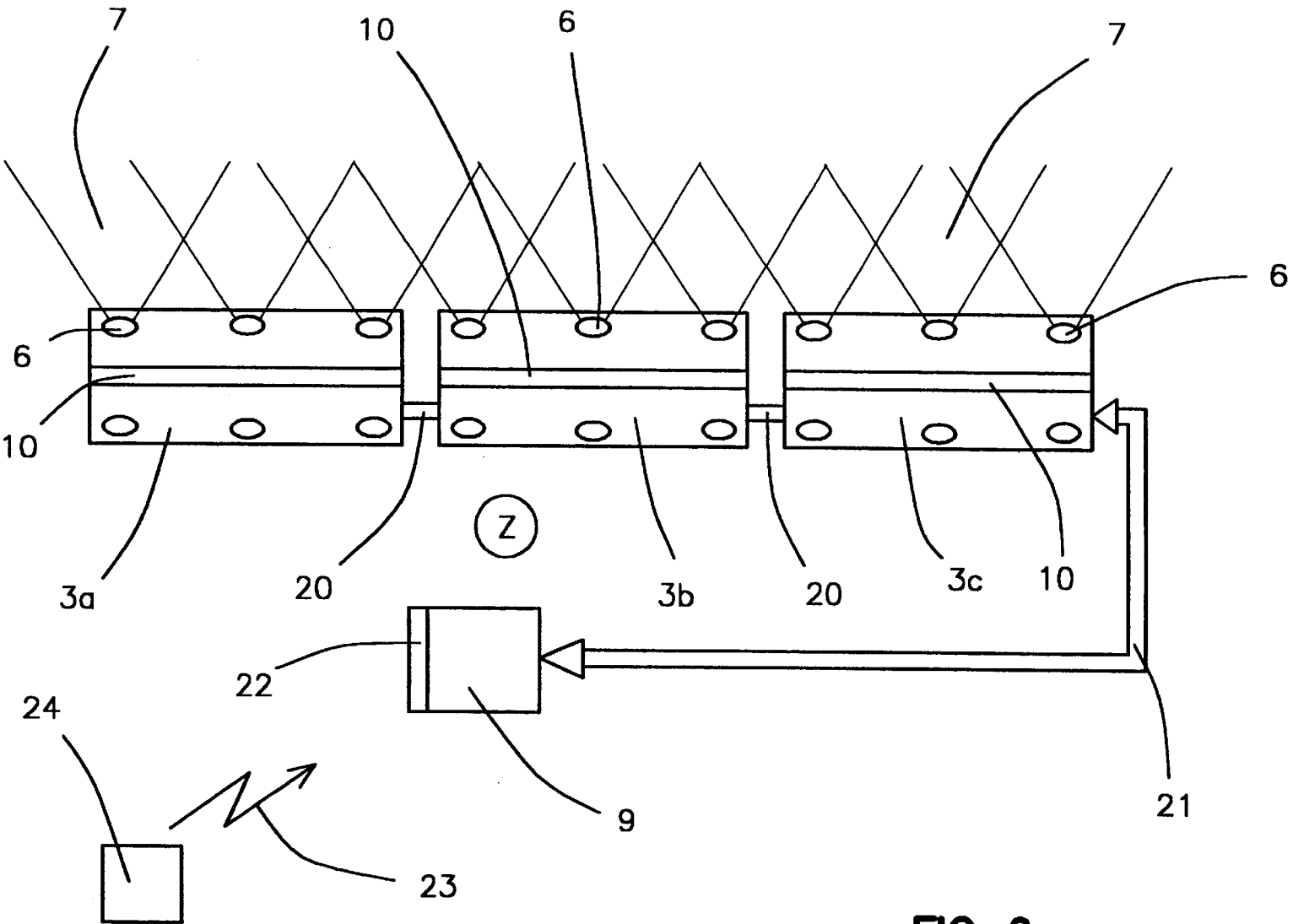
FIG. 6 shows the installation of a device of the invention when forming a barrier.

FIG. 6 shows a device constituted by mutually affixing three supports 3*a*, 3*b* and 3*c*. These supports may be designed as flexible mats, such as the one shown in FIG. 4 or they may be rigid or semi-rigid supports such as the one shown in FIG. 1.

A single control means 9 is linked to the various supports. The electric connections 20 are implemented between the different supports 3, and a connector 21 links the set of supports to the control means 9.

Preferably, the links 20 and 21 are buses (data and power transmission cables). The detectors 6 and the gas generators of the various supports 3*a*, 3*b* and 3*c* are fitted with individual addresses recognized by the control means, thereby accurately determining near which of the supports 3*a*, 3*b* or 3*c* an intrusion has taken place. Thereupon the control means 9 cause the appropriate envelope to inflate.

If the intruder moves from a first support 3*a* toward an adjacent support 3*b*, the detectors 6 of the support 3*b* transmit a detection signal to the control means 9 which then cause the envelope of support 3*b* to inflate.

Furthermore, the control means 9 may be fitted with a receiver 22 receiving remote commands 23 emitted from a remote monitoring station 24.

Figure 5:
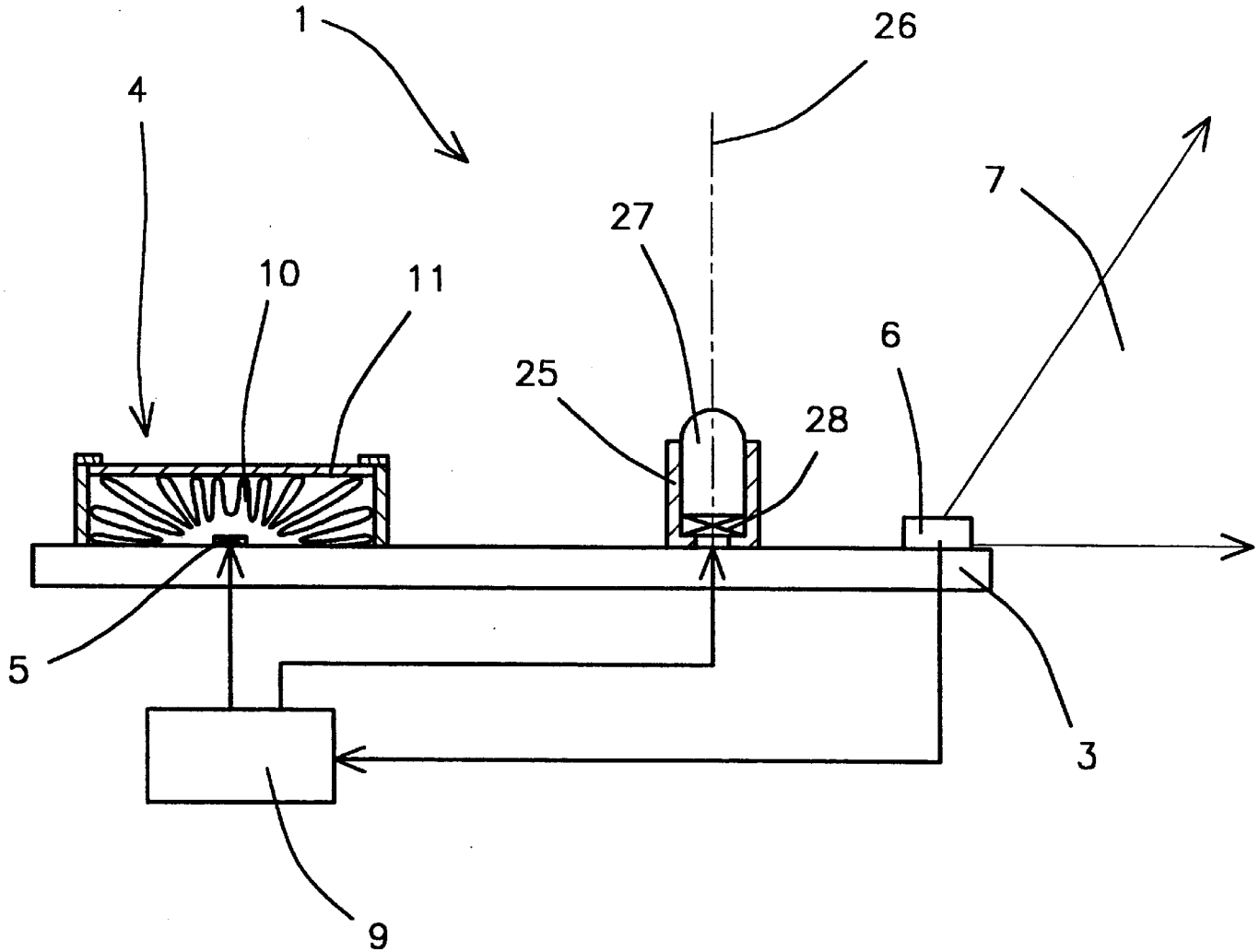
FIG. 5 is a schematic cross-section of a device of a third embodiment of the invention.

FIG. 5 shows a third embodiment of the invention, wherein the support 3 is fitted with a launcher tube 25 having a vertical axis 26 which is also perpendicular to the support 3 resting on the ground. The tube 25 encloses a projectile 27 which can be ejected from the tube 25 in the direction 26 by igniting a pyrotechnic expulsion charge 28.

The projectile 27 contains a charge, preferably a warning charge, which triggers with a delay along the projectile trajectory, and generates noise and/or light at a distance of about 5 m from the ground.

Such warning projectiles are well known to the expert, and therefore are not discussed in further detail.

In an embodiment variation, the projectile 27 may be equipped with an incapacitating charge, for instance tear gas dispersed along the trajectory when the projectile is fired.

This device operates as follows:

The detectors 6 signal the approach of an intruder a distance of several m away (the distance depending on the design of the particular detector being used). The detection signal is processed by the control means 9, which initiate firing the warning projectile for the purpose of deterring the intruder. At the same time, an alarm may be transmitted by the control means 9 to a remote monitoring station.

If the intruder remains near the device 1, or if he continues to advance toward the zone Z, the detectors 6 continue transmitting a detection signal to the control means 9. The control means then inflate the envelope 10.

This embodiment mode of the invention enables a graduated response (warning, then barrier) to detected intrusion attempts.

Preferably, the launcher tube is detachably mounted on the support 3, so as to allow replacement. Also the projectile may be firmly affixed to a propellant charge to constitute a munition that may be replaced or replenished, depending on operational needs.

In another embodiment variation of the invention, several launcher tubes pointing in different directions and optionally joined to a positioning, embedded, or surface platform may be used. In this design, the sensors are oriented for locating the intruder's position. Thereupon, the control means can select the tubes corresponding to the position of the identified threat.

Obviously as well, several supports of FIG. 5 may be combined to implement a barrier shown in FIG. 6. In this case, the control means may select the most appropriate munition as a function of the signals emitted by the various detectors.

What is claimed is:

1. An anti-intrusion device for protecting a zone from intrusion by a person, comprising at least one bag firmly affixed to at least one support configured for resting on a generally horizontal surface, said bag being fitted with a flexible envelope inflatable by at least one gas or fluid generator triggered by control means, said envelope spreading out above the support to subtend a substantially cylindrical volume having a longitudinal axis substantially parallel to a longitudinal axis of the support and having dimensions adequate to constitute a barrier hampering advance by a person into the zone protected by the device.

2. The device as claimed in claim 1, wherein the support comprises at least one intrusion detector linked to the control means.

3. Device as claimed in claim 1, wherein the support (3) is for supporting at least one launcher tube (25) for being loaded with at least one projectile (27).

4. Device as claimed in claim 3, wherein said at least one launcher tube is for pointing in a substantially vertical direction (26) and for loaded with at least one warning projectile (27).

5. device as claimed in claim 4, wherein the warning projectile contains a pyrotechnic charge generating noise and/or light.

6. Device as claimed in claim 4, wherein the warning projectile contains tear gas.

7. Device as claimed in claim 3, wherein the control means (9) is for driving the launcher tube (25) in response to intrusion detection.

8. Device as claimed in claim 7, wherein the control means (9) is for triggering inflation of the bag (4) when intrusion detection persists after initiating the launcher tube (25).

9. Device as claimed in claim 1 , wherein the surface of the support (3) is substantially rectangular and said support is for flexibly rolling into a spirally rolled form about a winding axis (16) parallel to its width.

10. The device as claimed in claim 1, wherein the support comprises at least one prohibitory marker.

11. Device as claimed in claim 1, wherein the support (3) further comprises a plurality of ends (19), wherein at least at one of said ends (19) comprises electric connection means (13) for electrically connecting said support to at leant one other support.

12. Device as claimed in claim 1, wherein the support (3) further comprises a plurality of ends (19), wherein at least at one of said ends (19) comprises mechanical connection means (17) for solidly joining said support with at least one other support.

13. Device as claimed in claim 1, wherein the control means (9) in for controlling jointly at least two supports (3).

14. The device as claimed in claim 1, wherein the gas generator comprises at least one pyrotechnic generator.

15. The device as claimed in claim 1, wherein the gas generator comprises at least one compressed gas bottle.

16. The device as claimed in claim 1, wherein the control means are linked to receivers for receiving remote commands.

17. The device as claimed in claim 1, wherein the bag is coated with an adhesive.

18. The device as claimed in claim 1, additionally comprising means for anchoring said device to said generally horizontal surface.

* * * * *